US009394870B2

(12) United States Patent
Nonaka et al.

(10) Patent No.: US 9,394,870 B2
(45) Date of Patent: Jul. 19, 2016

(54) FUEL INJECTION DEVICE

(71) Applicant: ZAMA JAPAN KABUSHIKI KAISHA, Iwate (JP)

(72) Inventors: Takumi Nonaka, Iwate (JP); Hideki Watanabe, Iwate (JP)

(73) Assignee: ZAMA JAPAN KABUSHIKI KAISHA, Iwate (JP)

( * ) Notice: Subject to any disclaimer, the term of this patent is extended or adjusted under 35 U.S.C. 154(b) by 0 days.

(21) Appl. No.: 14/720,042

(22) Filed: May 22, 2015

(65) Prior Publication Data

US 2015/0322907 A1 Nov. 12, 2015

Related U.S. Application Data

(63) Continuation of application No. 14/303,499, filed on Jun. 12, 2014, now Pat. No. 9,068,541, which is a continuation of application No. 13/024,641, filed on Feb. 10, 2011, now Pat. No. 8,752,528.

(30) Foreign Application Priority Data

Feb. 16, 2010 (JP) ..... 2010-031583

(51) Int. Cl.
*F02M 51/00* (2006.01)
*F02M 55/02* (2006.01)
(Continued)

(52) U.S. Cl.
CPC ..... *F02M 55/02* (2013.01); *F02M 37/0052* (2013.01); *F02M 55/04* (2013.01); *F02M 57/02* (2013.01); *F02M 57/026* (2013.01)

(58) Field of Classification Search
CPC ..... F02D 9/00; F02D 41/30; F02D 41/32; F02B 25/00; F02B 2075/025; F02M 1/00; F02M 1/16; F02M 7/20; F02M 9/12; F02M 17/04; F02M 37/20; F02M 51/04; F02M 63/02; F02M 67/00; F02M 69/00; F02M 69/04; F02M 69/22; F02M 69/46
USPC ..... 123/445, 446, 454, 461, 465, 469, 472, 123/478, 495, 497, 499, 502, 506, 507, 511, 123/514, 516, 71 R, 72, 73 AD, 73 AF; 261/35, 37, DIG. 23, DIG. 68, DIG. 8, 261/DIG. 74
See application file for complete search history.

(56) References Cited

U.S. PATENT DOCUMENTS 4,105,004 A 8/1978 Asai et al.
6,079,697 A 6/2000 Tuggle et al.
(Continued)

FOREIGN PATENT DOCUMENTS

JP 2001-193610 7/2001

*Primary Examiner* — John Kwon
*Assistant Examiner* — Johnny H Hoang
(74) *Attorney, Agent, or Firm* — One LLP

(57) ABSTRACT

A fuel injection device for smooth discharge of a gas accumulated therein comprising a fuel pump, a solenoid valve for injecting pressurized fuel into the intake passage of an engine, a high-pressure fuel passage extending from the fuel pump to the solenoid valve and has a medially positioned constant-pressure chamber, and a fuel return passage connected to a fuel return pipe, with the fuel return passage extending from the constant-pressure chamber and having a medially positioned priming pump. The constant-pressure chamber is configured with the top wall in the upper space thereof disposed above the opening of the high-pressure fuel passage opposite the solenoid valve, the fuel return passage opens into the upper space at a position above the opening of the high-pressure fuel passage, and the gas accumulating in the constant-pressure chamber is discharged from the upper space toward the fuel tank via the fuel return passage.

11 Claims, 2 Drawing Sheets

(51) Int. Cl.

| | |
|---|---|
| ***F02M 57/02*** | (2006.01) |
| ***F02M 37/00*** | (2006.01) |
| ***F02M 55/04*** | (2006.01) |

(56) References Cited

U.S. PATENT DOCUMENTS

| | | | |
|---|---|---|---|
| 6,354,571 | B1 | 3/2002 | Gerhardy |
| 6,374,782 | B2 | 4/2002 | Ishikawa et al. |
| 6,595,500 | B2 | 7/2003 | Osburg et al. |
| 6,698,727 | B1 | 3/2004 | Shaw |
| 6,702,261 | B1 | 3/2004 | Shaw |
| 6,802,284 | B2 | 10/2004 | Hironaka et al. |
| 6,913,250 | B2 | 7/2005 | Osburg et al. |
| 2002/0158349 | A1 | 10/2002 | Osburg et al. |
| 2002/0195726 | A1 | 12/2002 | Galka et al. |
| 2006/0000447 | A1 | 1/2006 | Ricco et al. |
| 2007/0084447 | A1 | 4/2007 | Nozaki et al. |
| 2008/0017170 | A1 | 1/2008 | Moroi et al. |
| 2008/0216797 | A1 | 9/2008 | Oono |
| 2009/0235900 | A1 | 9/2009 | Okamoto et al. |

↓ Direction of gravity

↓ Direction of gravity

↓ Direction of gravity

FUEL INJECTION DEVICE

CROSS-REFERENCE TO RELATED APPLICATION

This application is a continuation of U.S. application Ser. No. 14/303,499, filed Jun. 12, 2014, which claims priority to U.S. patent application Ser. No. 13/024,641, filed Feb. 10, 2011, now U.S. Pat. No. 8,752,528, which are hereby incorporated by reference in their entirety.

BACKGROUND OF THE INVENTION

1. Field of the Invention

The present invention relates to a fuel injection device for supplying fuel by injecting it into the intake path of an engine, and specifically relates to a fuel injection device that is provided with a priming pump for loading fuel into the fuel passage leading to the injector during engine start-up, and that is further provided with a fuel return path for returning the gas and excess fuel accumulated in the interior to the fuel tank.

2. Description of the Related Art

Fuel injection devices that pressurize and supply fuel by injecting it into the intake passage of an engine are well known, as described, for example, in Japanese Patent Publication No. 2001-193610. As shown in FIG. 3, the device has a fuel pump 31 used for pumping fuel and connected with a fuel supply line 5 that extends from the fuel tank, a solenoid (injector) 32 used for injecting fuel and connected with a high-pressure fuel passage 37 extending from the fuel pump 31, and a constant-pressure chamber 33B formed medially along the high-pressure fuel passage 37 and used to adjust the fuel injection pressure at a constant pressure. Fuel is injected into the intake passage 10 with a predetermined timing so as to be supplied to the engine.

Thus, with this fuel injection device 3B, the fuel return passage 39 extends from the constant-pressure chamber 33B and is connected to the fuel return line 6 that extends to the fuel tank. In addition, a priming pump 34B is provided medially along the fuel return passage 39, so that the air accumulated in the high-pressure fuel passage 37, including the constant-pressure chamber 33B, is discharged manually to the fuel tank at the time of engine start-up, allowing fuel to be introduced all the way up to the solenoid valve 32, and the vapor or excess fuel accumulated in the constant-pressure chamber 33B to be returned to the fuel tank via the fuel return passage 39 at the time of engine operation.

However, with the fuel injection device 3B and other conventional fuel injection devices, the fuel return passage 39 is positioned below the constant-pressure chamber 33B, as shown in the drawing, producing a structure in which the air that has low specific gravity and accumulates at the top is difficult to remove completely. In addition, the vapor that has been generated by the heat of engine operation is also likely to accumulate at the top in a similar manner, which tends to create a situation in which discharge is difficult.

When driving is stopped after engine operation, the fuel tank is heated by the residual heat of the engine, and the fuel inside tends to reach high pressure. To allow the priming pump 34B to operate adequately in response to this high pressure, the spring pressure of a check valve is commonly set high, making it difficult to sufficiently discharge the accumulated vapor with the discharge pressure generated by the fuel pump 31.

The problem thus arises that the air, vapor, or other gas accumulated in the high-pressure fuel passage 37 of the fuel injection device 3B causes pressure fluctuation in the device, impedes the outflow of fuel during discharge, and hence has a variety of adverse effects on engine performance during the period in which the gas is discharged from the solenoid valve 32 to the intake passage 10.

SUMMARY OF THE INVENTION

The preset invention is intended to resolve the types of problems described above, and is aimed at providing a fuel injection device for injecting and supplying fuel into the intake passage of an engine, wherein the gas that has accumulated in the device can be smoothly discharged from the device.

The present invention provides a fuel injection device comprising a fuel pump for pressurizing fuel, a solenoid valve for injecting pressurized fuel into the intake passage of an engine, a high-pressure fuel passage that extends from the fuel pump to the solenoid valve and has a medially positioned constant-pressure chamber for adjusting the fuel to a predetermined pressure, and a fuel return passage connected to a fuel return pipe, with the fuel return passage extending from the constant-pressure chamber and having a medially positioned priming pump, wherein the constant-pressure chamber is configured so that the top wall in the upper space thereof is disposed above the opening of the high-pressure fuel passage opposite from the solenoid valve, the fuel return passage opens into the upper space at a position above the opening of the high-pressure fuel passage, and the gas accumulating in the constant-pressure chamber is discharged from the upper space toward the fuel tank via the fuel return passage.

The constant-pressure chamber, which is the area where air or vapor tends to accumulate, is thus configured so that the fuel return passage opens into the upper space at a position above (higher than) the opening of the high-pressure fuel passage opposite from the solenoid valve. A gas that has low specific gravity and accumulates in the upper space of the constant-pressure chamber can flow unassisted into the fuel return passage, and the air or vapor can therefore be efficiently discharged.

According to another aspect of the fuel injection device, the constant-pressure chamber is configured so that the displacement surface of a diaphragm that constitutes pressure adjustment means has a lateral orientation, a vertical space is formed so that the width in a vertical direction is greater than the width in a diaphragm displacement direction perpendicular to the direction of gravity, the high-pressure fuel passage extending from the fuel pump is connected to a lower part of the space, the high-pressure fuel passage opposite from the solenoid valve opens into the space, and the fuel return passage extends from an upper part of the space. As a result, liquid fuel and gas such as air or vapor tend to separate one above the other, and the gas can be efficiently discharged.

According to yet another aspect of the fuel injection device, the priming pump has two laterally connected check valves disposed at a predetermined distance from each other in a medial portion of the fuel return passage, and further has cup-shaped suction/push-out means made of an elastic material for covering the open sides of the two check valves and forming a pump chamber; a bypass channel is formed between the two check valves; a nonreturn valve is provided for restricting passage of a fluid in the bypass channel only in the fuel return direction; the nonreturn valve is closed to block passage of the fluid when the priming pump is used; and the nonreturn valve is opened to allow passage of the fluid during fuel return or gas discharge, thereby producing a device in which discharge of excess fuel or gas is facilitated when the priming pump is not in use, and in which intake of fuel is facilitated when the priming pump is in use.

According to still another aspect of the fuel injection device, an external profile is formed as a substantially rectangular parallelepiped; the fuel pump is disposed inwardly with respect to the bottom surface of the substantially rectangular parallelepiped so that the diaphragm is parallel to the bottom surface; and the constant-pressure chamber is disposed inwardly with respect to one side surface of the substantially rectangular parallelepiped so that the diaphragm is parallel to the side surface. As a result, each of the functional parts is arranged in an efficient manner without being bulky, contributing to overall compactness.

In accordance with the present invention, in which the air inside the constant-pressure chamber is discharged from an upper space that faces the solenoid valve and is disposed above (higher than) the opening of the high-pressure fuel passage, gas that has accumulated in the device can be smoothly discharged.

DESCRIPTION OF THE PREFERRED EMBODIMENTS

Embodiments of the invention are described below in reference to the drawings. In the present invention, the upward and downward directions indicate directions corresponding to the direction of gravitational force in the typical state of use of the equipment in which the engine is mounted. In addition, the terms "upper space" and "lower space" denote upper and lower spaces relative to the vertically middle position in a predetermined space under typical conditions of use.

Figure 1:
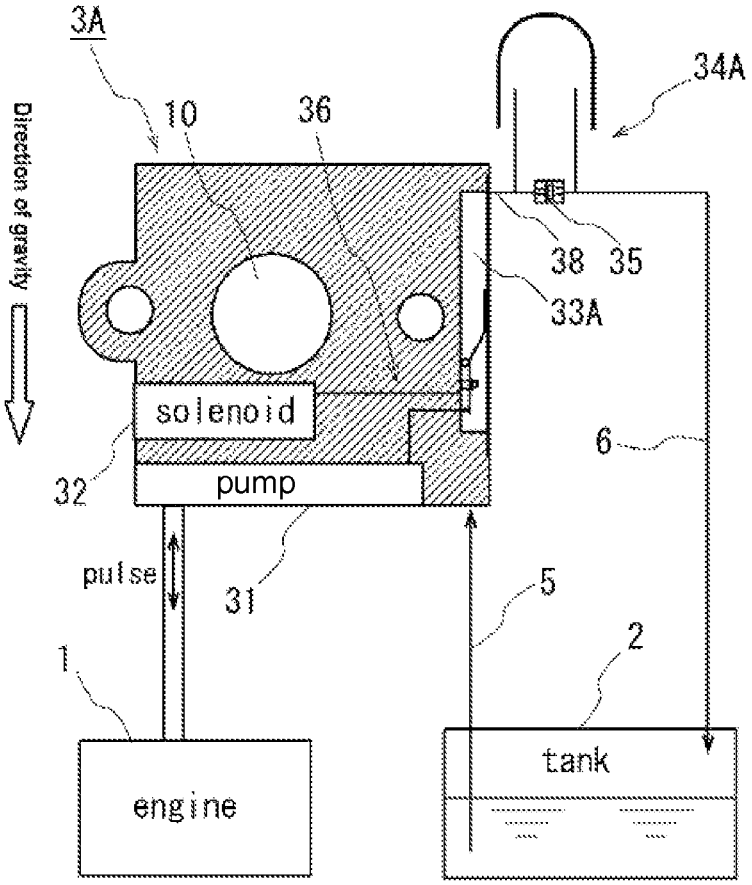
FIG. 1 is a layout diagram of the engine fuel supply system in which the fuel injection device is disposed according to an embodiment of the present invention.

FIG. 1 is a layout diagram depicting the configuration of the fuel supply system of an engine 1 in which a fuel injection device 3A is disposed in accordance with this embodiment. A fuel supply pipe 5 that extends from a fuel tank 2 is connected to the fuel injection device 3A disposed so as to constitute a portion of an intake passage 10 of the engine 1. Fuel is injected with a designated timing and supplied to the engine 1 via a solenoid valve 32 in which the injection opening side is exposed to the intake passage 10.

Figure 2:
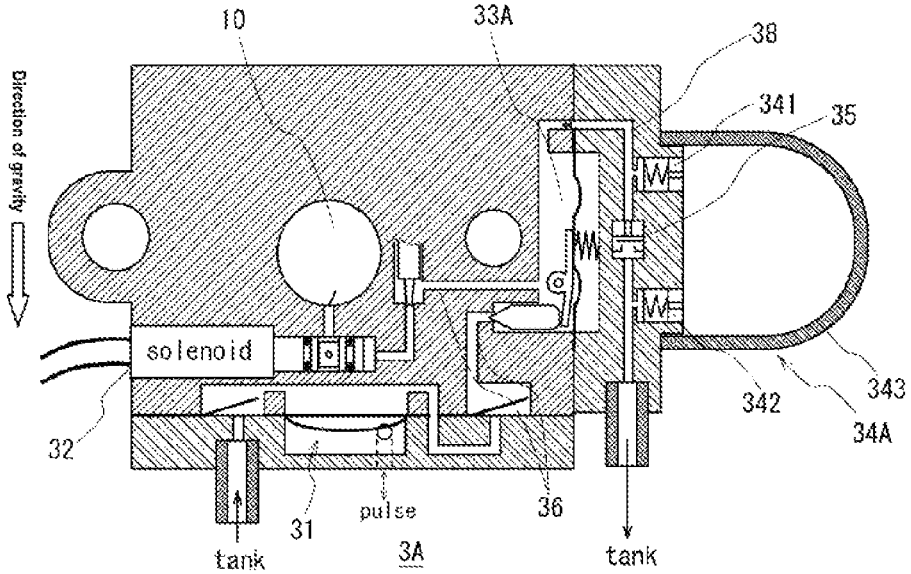
FIG. 2 is a vertical sectional view depicting the detailed configuration of the fuel injection device of FIG. 1.
Figure 3:
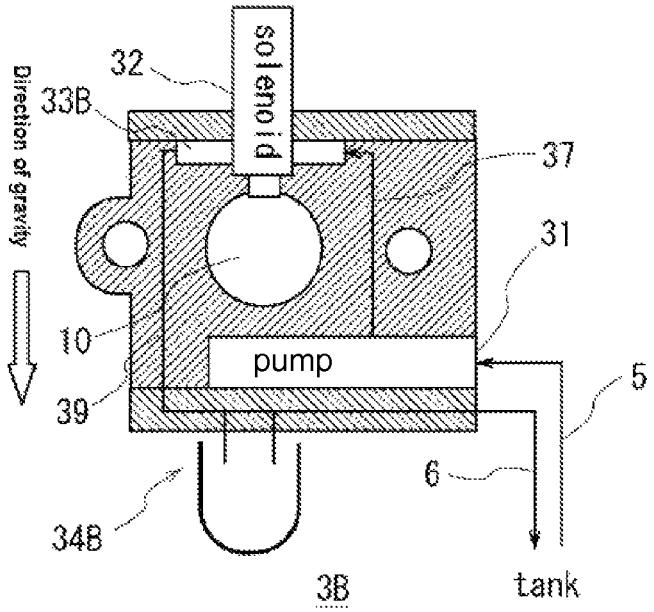
Fig. 3 (Prior Art)
FIG. 3 is a vertical sectional view of a conventional example.

In reference to FIG. 2, a fuel pump 31 having a fuel pressurization chamber partitioned by a diaphragm is mounted on the fuel injection device 3A, and the fuel is pressurized by the reciprocating displacement of the diaphragm through the introduction of a pulsating pressure from the engine 1 to the back pressure chamber, and is supplied to the solenoid valve 32 via the high-pressure fuel passage 36. In addition, a medially positioned constant-pressure chamber 33A is provided medially along the high-pressure fuel passage 36 and is used to adjust the fuel pressurized to a high pressure by the fuel pump 31 so that the fuel is kept at a constant pressure.

In addition, a fuel return passage 38 extends from the constant-pressure chamber 33A and connects to a fuel return pipe 6 so that excess fuel is returned to the fuel tank 2. Two check valves 341, 342 are connected at a designated distance medially on the side of the fuel return passage 38, and a cup-shaped member 343 made of an elastic resin is affixed as suction/push-out means so as to cover the space on the side surface to which the valve openings are exposed to form a priming pump 34A.

In this embodiment, the constant-pressure chamber 33A is formed so that the top wall of the upper space of the chamber is positioned above (higher than) the opening of the high-pressure fuel passage 36 opposite from the solenoid valve 32, and the opening of the fuel return passage 39 is disposed in the upper space at a location that is above (higher than) the opening of the high-pressure fuel passage 36, so that the air, vapor, or other gas accumulated in the constant-pressure chamber 33A is discharged from the upper space towards the fuel tank 2 via the fuel return passage 38.

When, in order to cease high-speed rotation, an accelerator (not illustrated) is released and the throttle lever 7 is returned to the original idle position, the throttle shaft 5 fixed to the throttle lever 7 rotates towards the closed direction due to the urging force of the urging device 6, returning to the original idle position. In this embodiment, a damping member 8 having frictional force is in contact with the throttle shaft 5 in a state of being pressed against the shaft, so that the return to the idle position occurs slowly over time rather than suddenly, as in conventional examples.

In this embodiment, the constant-pressure chamber 33A is configured so that the displacement surface of the pressure-adjusting diaphragm of the chamber faces to the side; a vertical space is formed so that the width of the space in the vertical direction is greater than the width of the space in the displacement direction; and the disk is placed upright so that the top surface faces sideways. In addition, the fuel return passage 38 extends from a location in the vicinity of the top wall in the upper space; the high-pressure fuel passage 36 that extends from the fuel pump 2 is connected at a location in the vicinity of the bottom wall in the lower space; and the high-pressure fuel passage 36 opens towards the solenoid valve 32 slightly above the passage.

With this configuration, the air, vapor, or other gas that has low specific gravity and accumulates in the upper space of the vertically elongated constant-pressure chamber 33A, which extends parallel to the direction of gravity, is readily separated in the vertical direction from the liquid fuel, and is smoothly discharged from the fuel return passage 38 that opens in the vicinity of the top wall of the upper space. On the other hand, the high-pressure fuel passage 36 opposite from the solenoid valve 32 opens into the lower space at a position away from the opening of the fuel return passage 38, allowing optimal engine performance to be maintained because the gas does not readily flow towards the solenoid valve 32.

The fuel return passage 38 is used both to discharge air, vapor, or other gases, and to allow the excess fuel that has been discharged from the fuel pump 31 to be returned to the fuel tank 2. In a conventional fuel injection device, however, the fuel in the fuel tank is pressurized by high temperatures after the engine is stopped. To overcome this shortcoming, the spring pressure of the check valve of the medially disposed priming pump 34A is set high, and considerable resistance is created to the passage of materials through this section, impeding the flow of excess fuel and the discharge of gas.

In this embodiment, two check valves 341, 342 are connected at a designated distance from each other on the side of the fuel return passage 38; a bypass passage is left between the two check valves 341, 342; and a non-return valve 35 is disposed in this portion to prevent passage of fluid only in the fuel return direction. The discharged fuel will thereby be prevented from flowing backwards while being admitted into the pump in an efficient manner, when the priming pump 34A is used during engine start-up. The excess fuel or air will be caused to bypass the priming pump 34A and to flow via the nonreturn valve 35 in a smooth manner during times other than engine startup.

In this embodiment, the fuel injection device 3A has a substantially rectangular parallelepiped external shape, the fuel pump 31 is provided with a diaphragm on the inside of the bottom surface parallel to the bottom surface, and the constant-pressure chamber 33A is provided with a diaphragm parallel to the side surf ace and inward of one side surface thereof. Consequently, the respective required functional parts are arranged in the fuel injection device in an efficient manner without being bulky, and overall compactness is achieved.

As described above, the present invention provides a fuel injection device for injecting and supplying fuel to the intake passage of an engine. Gas that has accumulated in the device can be smoothly discharged, the supplied fuel can be kept at a stable pressure and flow rate during engine operation, and optimal engine performance can be maintained.

| KEY | |
|---|---|
| 1 | Engine |
| 2 | Fuel tank |
| 3A | Fuel injection device |
| 5 | Fuel supply pipe |
| 6 | Fuel return pipe |
| 10 | Intake passage |
| 31 | Fuel pump |
| 32 | Solenoid valve |
| 33A | Constant-pressure chamber |
| 34A | Primping pump |
| 35 | Non-return valve |
| 36 | High-pressure fuel passage |
| 38 | Fuel return passage |
| 341, 342 | Check valves |

The invention claimed is:

1. A fuel injection device, comprising:

a fuel pump that pressurizes fuel;

a solenoid valve that injects the pressurized fuel into an intake passage;

a constant pressure chamber, a first high-pressure fuel passage extending from the fuel pump to the constant pressure chamber and a second high-pressure fuel passage extending from the constant pressure chamber to solenoid valve; and a fuel return passage that extends from the constant pressure chamber to a fuel return pipe, wherein the constant pressure chamber includes an upper wall positioned above a first opening to the high-pressure fuel passage heading toward the solenoid valve and a second opening to the fuel return passage positioned above the opening portion of the high-pressure fuel passage, wherein gas accumulated in the constant pressure chamber is exhausted from the constant pressure chamber via the fuel return passage.

2. The fuel injection device according to claim 1, further comprising a priming pump connected to the fuel return passage.

3. The fuel injection device according to claim 1, further comprising a fuel return pipe connected to the fuel return passage.

4. The fuel injection device according to claim 2, further comprising first and second check valves interconnected to the priming pump and the fuel return passage and positioned at a predetermined interval along the fuel return passage.

5. The fuel injection device according to claim 4, wherein the priming pump includes a cup shape that covers an opening side of the first and second check valves and forms a pump chamber.

6. The fuel injection device according to claim 4, wherein the fuel return passage includes a bypass path formed between the first and second check valves and includes a non-return valve that restricts passage of a fluid in the bypass path to only a fuel return direction.

7. The fuel injection device according to claim 6, wherein the non-return valve is configured to close when the priming pump is activated.

8. The fuel injection device according to claim 1, wherein the constant pressure chamber includes a diaphragm having a direction of displacement that is orthogonal to a gravitational direction.

9. The fuel injection device according to claim 1, wherein the fuel injection device includes a rectangular parallelepiped shape.

10. The fuel injection device according to claim 9, wherein the fuel pump is positioned at a bottom surface of the rectangular parallelepiped with a pump diaphragm positioned parallel to the bottom surface.

11. The fuel injection device according to claim 10, wherein the constant pressure chamber is positioned on a side surface of the rectangular parallelepiped with a pump diaphragm positioned parallel to the side surface.

* * * * *